US006518000B1

(12) United States Patent
Begley et al.

(10) Patent No.: US 6,518,000 B1
(45) Date of Patent: Feb. 11, 2003

(54) INFRARED COUPLERS FOR INCORPORATING AND RECOVERING METADATA

(75) Inventors: William J. Begley, Webster, NY (US); Gary M. Russo, Rochester, NY (US); Mathilde R. Triguel, Grieshiem (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/060,691

(22) Filed: Jan. 30, 2002

(51) Int. Cl.[7] ..... G03C 1/46

(52) U.S. Cl. ..... 430/385; 430/552; 430/553; 430/944; 430/304

(58) Field of Search ..... 430/384, 385, 430/552, 553, 944, 502, 503, 523, 449

(56) References Cited

U.S. PATENT DOCUMENTS 4,233,389 A 11/1980 Fernandez et al.
4,362,810 A * 12/1982 Usagawa et al. ..... 430/552
4,613,565 A * 9/1986 Takada et al. ..... 430/552
4,863,840 A * 9/1989 Komorita et al. ..... 430/553
5,842,063 A 11/1998 Hawkins et al.

FOREIGN PATENT DOCUMENTS

JP 63-36236 * 2/1988
JP 4-199148 * 7/1992

* cited by examiner

*Primary Examiner*—Geraldine Letscher
(74) *Attorney, Agent, or Firm*—Arthur E. Kluegel

(57) ABSTRACT

Disclosed is a photographic element comprising a light-sensitive silver halide emulsion layer having associated therewith a coupler that forms a dye for which the $\lambda_{max}$ using spin-coating is shifted towards the infrared region of the spectrum by at least 30 nm, when compared to the $\lambda_{max}$ of the same dye in solution form, to a value of at least 700 nm. Such an element is useful for recording metadata with an image.

36 Claims, No Drawings

INFRARED COUPLERS FOR INCORPORATING AND RECOVERING METADATA

FIELD OF THE INVENTION

This invention relates to a silver halide photographic element comprising a light-sensitive silver halide emulsion layer having associated therewith an "Infrared coupler" that forms a dye for which the $\lambda_{max}$ using spin-coating is shifted towards the infrared region of the spectrum by at least 30 nm, when compared to the $\lambda_{max}$ of the same dye in solution form, to a value of at least 700 nm, which is useful for incorporating and recovering metadata, such as sound data, in a photographic image and is specifically concerned with the incorporation of non-visually perceptible sound information into a photograph.

BACKGROUND OF THE INVENTION

With the advent of digital printing capability in silver halide systems, the ability to combine information such as text, numbers, or other information, to color photographs has become possible. The use of computers and sophisticated computer software make it possible to combine digital image data originating from sources such as a digital camera, a computer image or from a silver halide film or paper, which had been electronically scanned, with additional information, then send the combined encoded data to a digital film or paper writer to produce a photograph.

The conversion of non-image wise information such as text, numbers or other graphics, commonly known as metadata, to digital information is well known in many industries. Converting analogue sound information to a digital data is also well known, and many digital still cameras and all video-recording cameras have this feature. The desire to include sound information with pictures has long been a goal. In video cameras, sound is captured with the image on videotape and replayed through a television. In still cameras, the ability to record sound exists, but the capability to embed the sound information along with the pictorial information has been elusive despite several strategies.

Akamine et al in U.S. Pat. No. 5,664,557 has disclosed a system for recording and reproducing sound as a visible 2-dimensional bar code using a thermal printer. The recorded sound can be printed onto a label and then affixed to an object such as a photograph and subsequently scanned with a bar code reader by the viewer. The reader reinterprets the bar code as sound data and then plays the sound through a speaker. The difficulty with this system is that the sound image and the pictorial image are spatially and temporally separate. In addition, if the label is affixed to the back of the image, the viewer cannot conveniently place the image in an album where it would first have to be removed in order to be interpreted. If the label is affixed to the image itself, it detracts from the image and if affixed to the album, requires its own space in the album and detracts from the aesthetic quality of the album. Hence, it is clearly more desirable for the picture to have the sound associated with it, but in an invisible way so that it not detract from the quality of the picture or album or inconvenience the viewer in any other way.

The ability to include sound information and image information has been demonstrated in the motion picture industry with the integral sound track technology. The sound track is comprised of a spatially separate ribbon of developed silver placed along side the frame containing the image. The silver sound image remains in the film by a unique step in the processing cycle so that it is not removed with the silver used to form the image. The 'sound' file is written onto the film in a separate exposing step using a sound negative. The 'sound' information is read from the print film by using an infrared sensor to measure the modulation of the silver image as a function of density and time. To achieve high fidelity sound images, a large range of developed silver density is required.

Because of the added complexity to the processing chemistry and the number of additional steps required to include the sound track, other strategies have evolved to overcome these problems. One such strategy has been described by Ciurca et al in U.S. Pat. No. 4,178,183 and improved upon by Fernandez et al in U.S. Pat. No. 4,233,389. These inventions replace the silver sound track with one comprised of an infrared light absorbing dye. The coupler which forms the dye is coated in the film in a $4^{th}$ sensitized layer, and after exposure and development forms an infrared dye whose density is proportional to the sound signal from the sound negative. Modulation of this $4^{th}$ infrared dye forming layer then produces a response similar to that of a developed silver sound track, but does not require special processing of the print film. Much like the silver sound track image, to reproduce a high fidelity sound, a wide dynamic range of infrared density is required and as a result, infrared dye densities of at least 3.0 are required in order to obtain hi-fidelity sound quality.

Hawkins et al in U.S. Pat. No. 5,842,063 teaches that the dye produced by the coupler in the layer sensitized to record non-imagewise information should absorb in the regions of the spectrum not appreciably overlapping with the regions of absorption of the other color records in order that the developed record of the digital data not interfere with the viewing of the pictorial records. To accomplish this, he proposes the use of infrared dye forming couplers coated onto the imaging element in an additional layer to the imaging records. However, he does not suggest any preferred compositions.

Due to the inherent chemical nature of organic dyes, formed in chromogenic reactions with para-phenylenediamine type color developers, the spectral absorption bands are often broader than desired. In color negative films, the unwanted absorptions of the dyes are compensated for by the colored coupler masking dyes and by additional chemistry in the film called inter-image chemistry such as development inhibitor releasing (DIR) chemistry. In the case of couplers that form infrared dyes, their chemical compositions can be such that a variety of dyes having different $\lambda_{max}$ values, or peak absorptions, are known.

The unwanted adsorptions of the high density of the infrared dye required to produce an adequate signal to noise ratio in the motion picture print film is not an issue when the sound track and the image are spatially distinct. However, since it is desirable to have the sound image and the pictorial image in the same spatial area of the print, then the so-called unwanted absorptions of the infrared image dye must be minimized so that they do not contribute non-imagewise information to the picture.

It is, therefore, highly desirable to design a system wherein the photographic element has the ability to record metadata such as sound or other information in the same spatial area as the imagery with an 'invisible dye' so that the metadata information does not degrade the pictorial quality of the image and is co-optimized with the design of the sensor which reads the invisibly encoded metadata image.

Prior Art

Ciurca et al in U.S. Pat. No. 4,178,183 discloses a photographic element useful for forming integral soundtracks, particularly for motion picture print films, by incorporating micro-crystalline infrared absorbing dyes in a $4^{th}$ sensitized layer.

Fernandez et al in U.S. Pat. No. 4,233,389 discloses a photographic element useful for forming integral soundtracks, particularly for motion picture print films, by incorporating micro-crystalline infrared absorbing dyes in a $4^{th}$ sensitized layer.

Sakai et al in U.S. Pat. No. 4,208,210 discloses a photographic element useful for forming integral soundtracks, particularly for motion picture print films, by incorporating infrared absorbing dyes in a $4^{th}$ sensitized layer wherein the $_4$th sensitized layer is sensitive to the ultraviolet light.

Powers et al in U.S. Pat. No. 4,816,378 discloses an imaging process and photographic element useful for forming half-tone color proof images by incorporating a $4^{th}$ sensitized layer which contains a black or infrared dye.

Hawkins et al in U.S. Pat. No. 5,842,063 discloses a camera, film and method for recording overlapping visual and digital images in the same region of the film.

Soscia et al in U.S. application Ser. No. 09/099,616 filed Jun. 18, 1998, discloses a method and apparatus for reading invisibly printed sound data on an object, the invisible sound data being imprinted by an invisible dye from a thermal dye transfer process, an invisible printing ink, or a special photographic printing paper containing an infrared absorbing layer.

Soscia et al in U.S. application Ser. No. 09/099,627 filed Jun. 18, 1998, discloses a system and apparatus for printing invisible sound data on an object the sound data component being comprised of an infrared dye, the invisible sound data being imprinted by an invisible dye from a thermal dye transfer process.

Haraga et al in European Patent Application EP 0 915 374 A1 describes an imaging method comprising a photographic element containing a $4^{th}$ sensitized layer which is designed to add invisible image information to an image.

Patton et al in U.S. Pat. No. 5,774,752 describes a method for processing photographic still images having sound information associated with them.

Akamine et al in U.S. Pat. No. 5,664,557 describes an audio data recording/reproduction system for printing optically readable code on photographic paper as a visible image.

Haga in U.S. Pat. No. 5,629,512 describes an information reading apparatus for reading invisible information encoded in an underlying layer of a recording medium which fluoresces upon being exposed to light of a specific wavelength.

Parton et al in U.S. Pat. No. 5,108,882 describes a photographic element having at least one photographic emulsion layer which is sensitized to infrared light.

Inoue et al in U.S. Pat. No. 5,313,235 describes a sound playback apparatus capable of decoding magnetically encoded sound information which has been previously encoded into an image recording medium such as a photograph.

It is a problem to be solved to provide a novel photographic element capable of effectively recording and recovering metadata, such as sound information, in a way that the quality of the image is not diminished.

SUMMARY OF THE INVENTION

The invention provides a photographic element comprising a light-sensitive silver halide emulsion layer having associated therewith a coupler that forms a dye for which the $\lambda_{max}$ using spin-coating is shifted towards the infrared region of the spectrum by at least 30 nm, when compared to the $\lambda_{max}$ of the same dye in solution form, to a value of at least 700 nm.

Such an element is useful for recording metadata with an image.

DETAILED DESCRIPTION OF THE INVENTION

The invention provides a photographic element comprising a light-sensitive silver halide emulsion layer having associated therewith an "Infrared coupler" that forms a dye for which the $\lambda_{max}$ (wavelength at which maximum absorption occurs) using spin-coating is shifted towards the infrared region of the spectrum by at least 30 nm to a value of at least 700 nm when compared to that of the same dye in solution form and preferably having the formula (I):

(I)

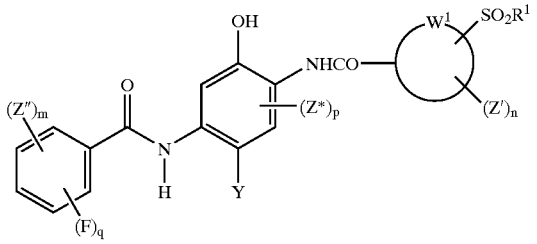

wherein

F is a fluorine atom where q is 1 to 4;

Y is H or a coupling-off group;

$R^1$ is an alkyl, carbocyclic or heterocyclic group;

each Z', Z" and Z* is an independently selected substituent group where n and m are independently 0 to 4 and p is 0 to 2;

$W^1$ represents the atoms necessary to complete a carbocyclic or heterocyclic ring group; and provided that the combined sum of the aliphatic carbon atoms in R', all Z', Z" and Z* is at least 8.

The invention also provides a coupler of formula (I) and an imaging process employing the element. The infrared dye formed in the element of the invention is useful for recording metadata.

The invention may be generally described as summarized above. The coupler is an "Infrared coupler" of formula (I) having substituents so that there is a shift in the wavelength of maximum absorption or $\lambda_{max}$ of at least 30 nm towards the infrared region of the spectrum in spin-coating form vs. solution form. In accordance with the procedure, a dye is formed by combining the coupler and the developer 4-amino-3-methyl-N-ethyl-N-(2-methanesulfonamidoethyl) aniline sesquisulfate hydrate. If the wavelength of maximum absorption or $\lambda_{max}$ of its absorption spectra upon "spin coating" a 3% w/v solution of the dye in 3% w/v di-n-butyl sebacate in a low boiling point solvent is shifted bathochromically at least 30 nm towards the infrared to a value of at least 700 nm when compared to a solution of the same dye in acetonitrile, then the coupler is an "Infrared coupler".

The "spin coating" sample is prepared by first preparing a 3% w/v solution of the dye in 3% w/v di-n-butyl sebacate in a low boiling point solvent such as tetrahydrofuran. The solution is filtered and 0.1–0.2 ml is applied to a clear polyethylene terephthalate support (approximately 4 cm×4 cm) and spun at 4,000 RPM using the Spin Coating equipment, Model No. EC101, available from Headway Research Inc., Garland Tex. The transmission spectra of the so prepared dye samples are then recorded.

Preferred "Infrared couplers" form dyes which have $\lambda_{max}$, values in their absorption spectra upon "spin coating" a sample of the dye in di-n-butyl sebacate, shifted towards the infrared region of the spectrum of at least 30 nm, preferably at least 40 nm or 50 nm, over the same dye in acetonitrile solution.

The following limitations apply to formulae (I)–(XIV) where the corresponding symbols appear:

Y is H or a coupling-off group. Coupling-off groups are more fully described hereinafter. Typically, Y is H, halogen such as chloro, phenoxy, or alkoxy. It can be bonded to the coupler via a heteroatom, or it can be selected from the group consisting of aryloxy, arylthio, alkylthiol, and heterocyclic groups.

$R^1$ is an alkyl, carbocyclic or heterocyclic group. Preferred $R^1$ groups are straight chain or branched alkyl groups of 1–30 carbon atoms or carbocyclic groups containing 1–30 aliphatic carbon atoms. It is also possible that the employed alkyl or aryl group is substituted with for example acyl, acyloxy, alkenyl, alkyl, alkoxy, aryl, aryloxy, carbamoyl, carbonamido, carboxy, cyano, halogen, heterocyclic, hydroxy, nitro, oxycarbonyl, oxysulfonyl, sulfamoyl, sulfonamido, sulfonyl, sulfoxide, thio, and ureido groups, or may be fully substituted to provide, for example, a perfluorinated substituent.

Each Z', Z" and Z is an independently selected substituent group where p is 0 to 2, and n and m, independently are 0 to 4. Suitable substituent groups are more fully described hereinafter. Typically p is 0. Z', Z" and Z* may be any substituent and, for example, may be independently selected from acyl, acyloxy, alkenyl, alkyl, alkoxy, aryl, aryloxy, carbamoyl, carbonamido, carboxy, cyano, halogen, heterocyclic, hydroxy, nitro, oxycarbonyl, oxysulfonyl, sulfamoyl, sulfonamido, sulfonyl, sulfoxide, thio, and ureido groups. Convenient substituents are alkyl, alkoxy, sulfonyl, sulfamoyl, nitro, and halogen groups. The total combined sum of the aliphatic carbon atoms in $R^1$ all Z', all Z" and all Z* groups in the appropriate formulae is at least 8.

In Formulae (1), et seq, $W^1$ represents the atoms necessary to form a heterocyclic or carbocyclic ring group. Suitable heterocyclic rings include those containing 5 or 6 ring members and at least one ring heteroatom. Heterocycles useful herein may be aromatic or non-aromatic and contain at least one atom of oxygen, nitrogen, sulfur, selenium, or tellurium. They can be fused with a carbocyclic ring or with another heterocycle. They can be attached to the coupler through any of the possible points of attachment on the heterocycle. It should be realized that multiple points of attachment are possible giving rise to alternative isomers for a single heterocycle. Examples of useful heterocyclic groups are benzimidazolyl, benzoselenazolyl, benzothiazolyl, benzoxazolyl, chromonyl, furyl, imidazolyl, indazolyl, indolyl, isoquinolyl, isothiazolyl, isoxazolyl, morpholinyl, oxadiazolyl, oxazolyl, picolinyl, piperidinyl, purinyl, pyradazinyl, pyranyl, pyrazinyl, pyrazolyl, pyridyl, pyrimidinyl, pyrrolyl, pyrrolidinyl, quinaldinyl, quinazolinyl, quinolyl, quinoxalinyl, selenazoyl, tellurazolyl, tetrazolyl, tetrahydrofuryl, thiadiazolyl, thiamorpholinyl, thiatriazolyl, thiazolyl, thienyl, thiophenyl, triazinyl and triazolyl groups.

Examples of suitable heterocycles for $R^1$ are those based on a benzimidazole, benzotriazole, furan, imidazole, indazole, indole, isoquinoline, purine, pyrazole, pyridine, pyrimidine, pyrrole, quinoline, thiophene, 1,2,3-triazole, 1,2,4-triazole, or 1,3,5-triazine ring group, but can also include those listed above for $W^1$ groups. Conveniently useful are the nitrogen-containing rings such as pyridine with the nitrogen in the 2-, 3-, or 4- position, as well as the various pyrimidine, pyrazole or triazine alternatives. Examples of suitable carbocyclic rings for $R^1$ (or $W^1$) include cyclohexyl, phenyl and naphthyl with phenyl rings being most conveniently used.

In formulae (I)–(XIV) F represents a fluorine atom. In formulae (I)–(II) q is selected from 1–4 and the fluorine atoms can be located at any position around the phenyl ring, either adjacent to each other or separated by Z" groups or hydrogen. In addition, when q is greater than 1, one or two fluorine atoms may occupy the two positions ortho to the arnido carbonyl group, or zero fluorine atoms may occupy these ortho positions. Formulae (III)–(VI) represent examples of the invention where various numbers of fluorine atoms are located at non-specific sites. Formulae (VII)–(XIV) represent examples of the invention where various numbers of fluorine atoms are located at specific sites. For practical reasons, not all possible combinations of number and location of fluorine atoms on the phenyl ring are represented in these formulae, so it should be realized that examples of the invention are not limited to formulae (VII)–(XIV). In addition, the invention is not limited to the location of the —$SO_2R^1$, all Z' and all Z" groups given in the examples.

A useful embodiment of the invention where $W^1$ represents the atoms necessary to form a phenyl ring is shown in formula (II):

(II)

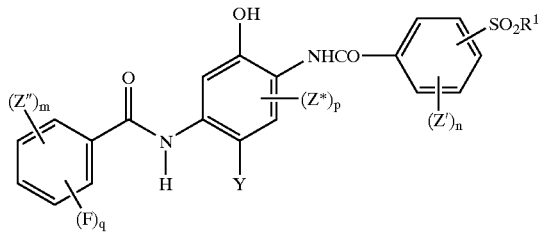

Particular embodiments of the invention are as shown in formulae (III)–(VI):

(III)

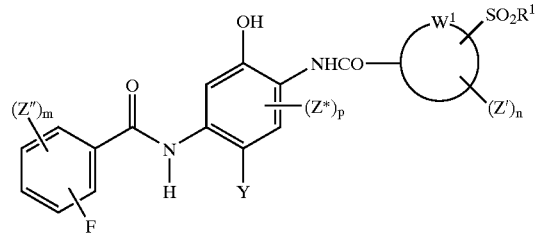

-continued (IV)

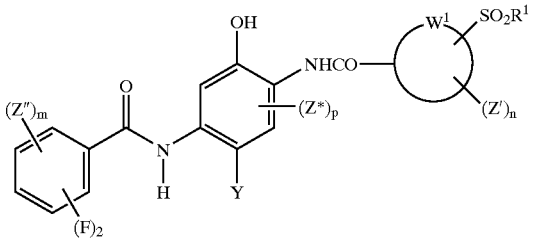

(V)

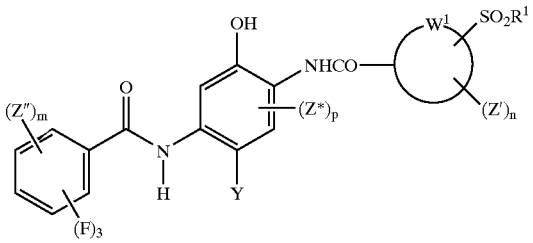

(VI)

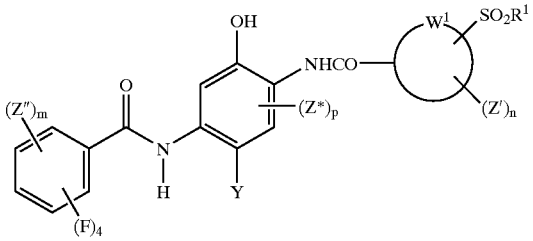

wherein:

F is a fluorine atom;

Y is H or a coupling-off group;

each Z', Z" and Z* is an independently selected substituent group where n and m are independently 0 to 4 and p is 0 to 2;

$W^1$ represents the atoms necessary to complete a carbocyclic or heterocyclic ring group; and provided that the combined sum of the aliphatic carbon atoms in all Z', Z" and all Z* is at least 8.

More specific embodiments are as shown in the formulae (VII)–(XIV):

(VII)

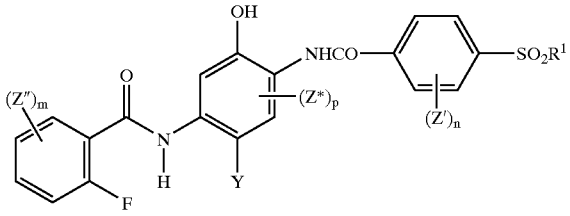

-continued (VIII)

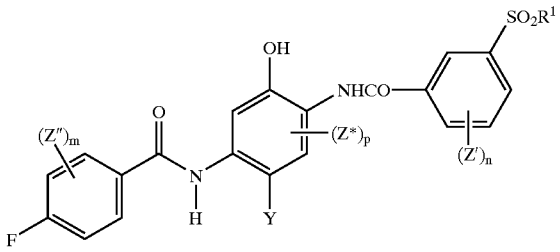

(IX)

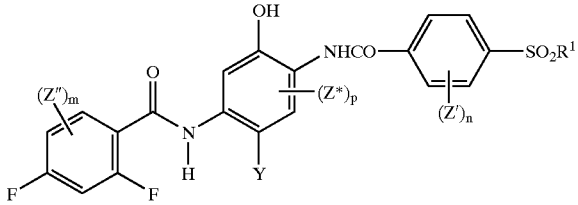

(X)

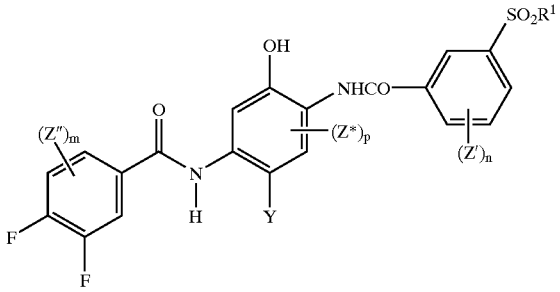

(XI)

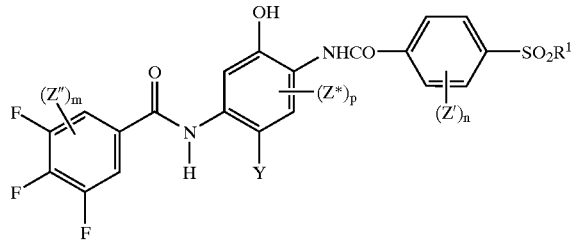

(XII)

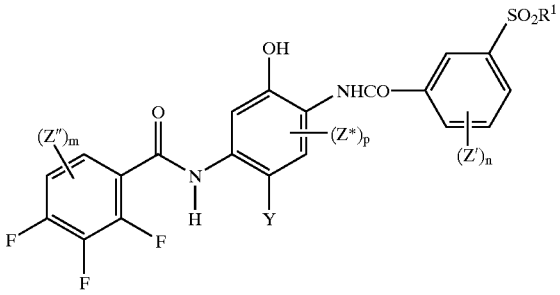

-continued
(XIII)
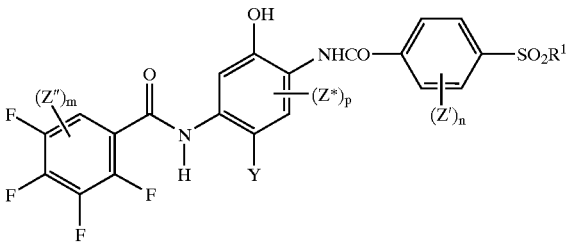
(XIV)
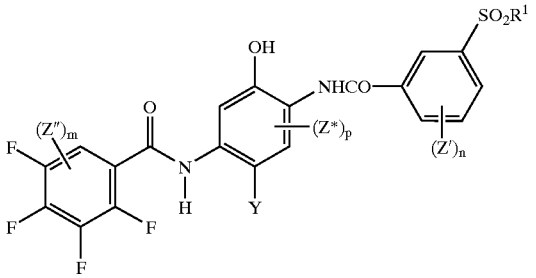
The following are examples of couplers useful in the invention:
IC-1
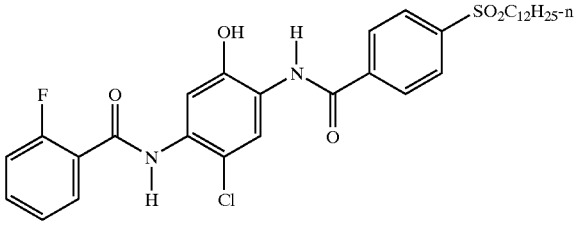
IC-2
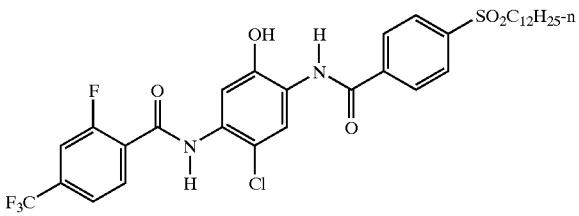
IC-3
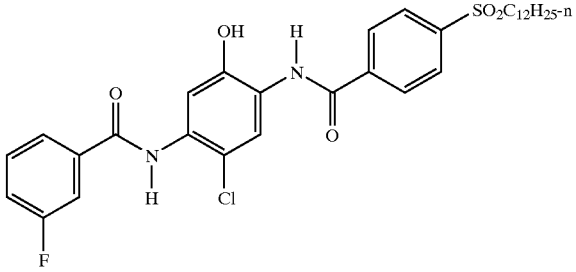
-continued
IC-4
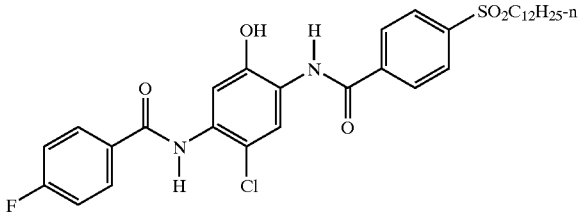
IC-5
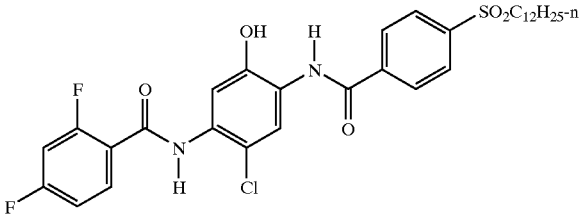
IC-6
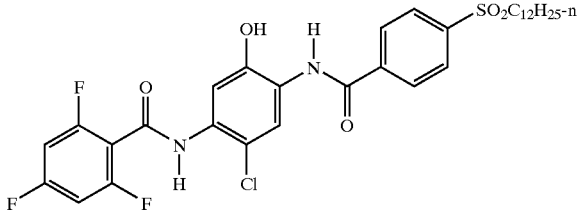
IC-7
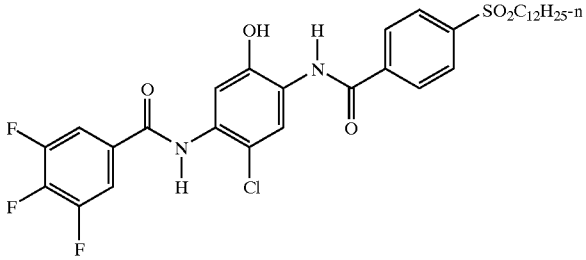
IC-8
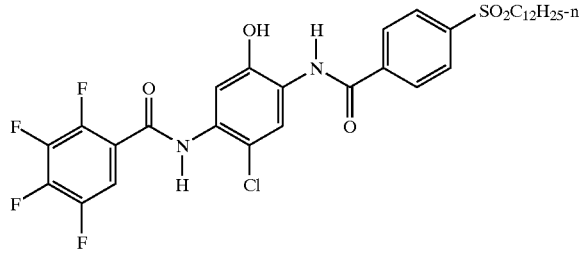
IC-9
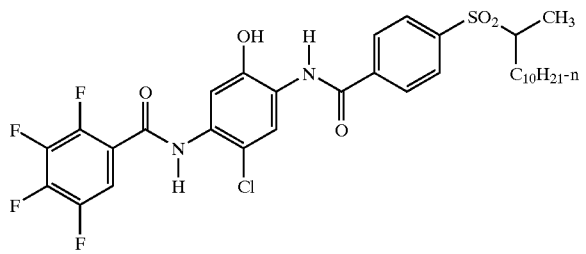

-continued
IC-10
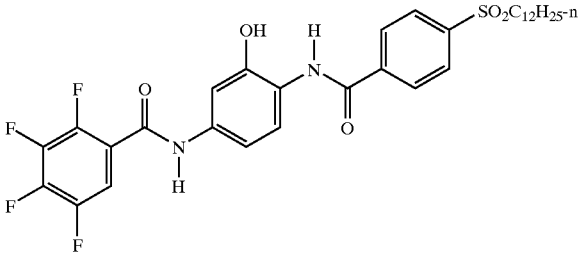
IC-11
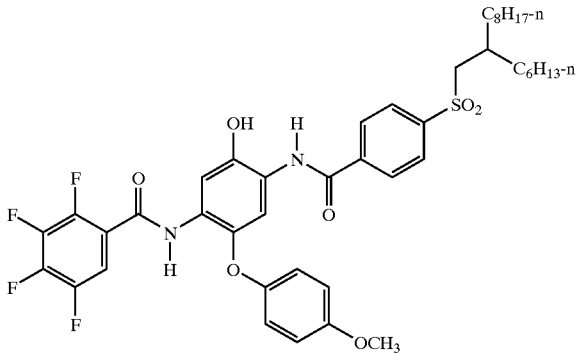
IC-12
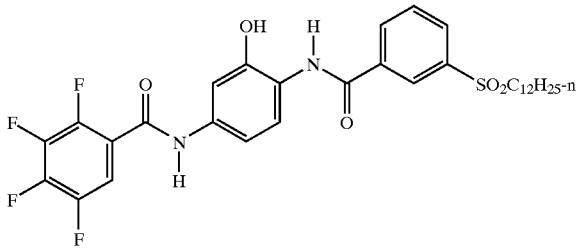
IC-13
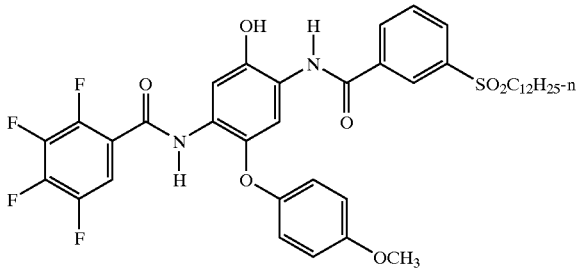
IC-14
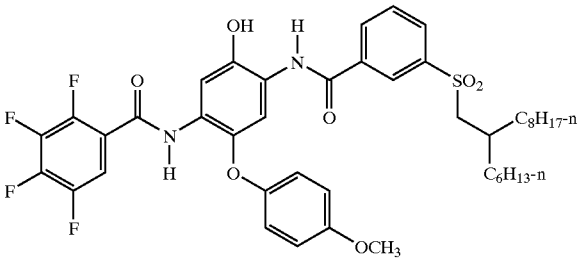
-continued
IC-15
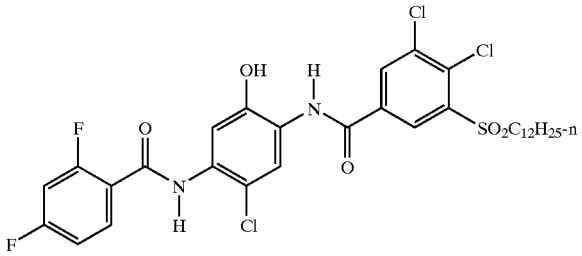
IC-16
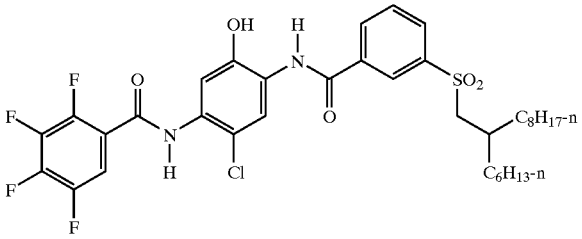
IC-17
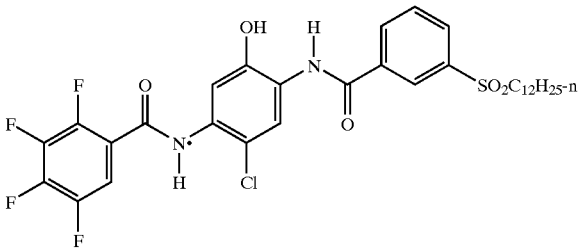
IC-18
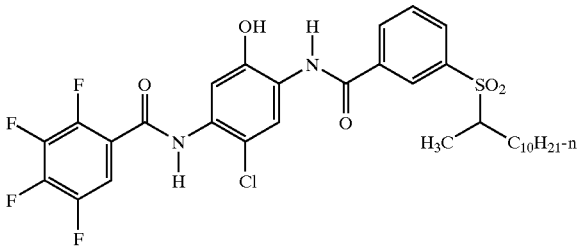
IC-19
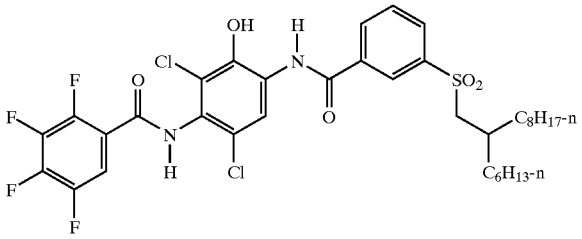
IC-20
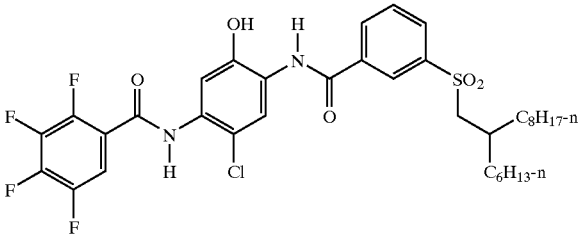

-continued
IC-21
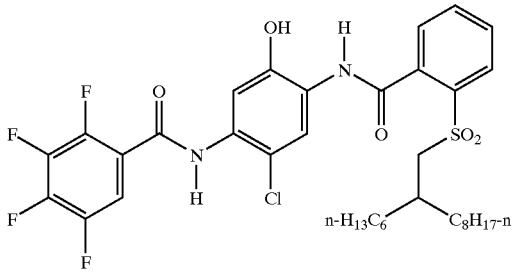
IC-22
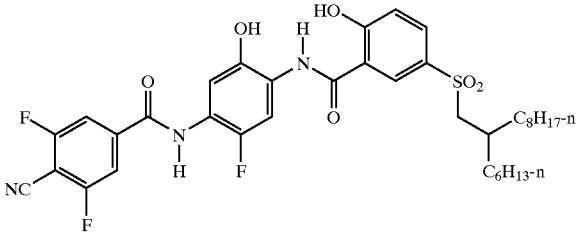
IC-23
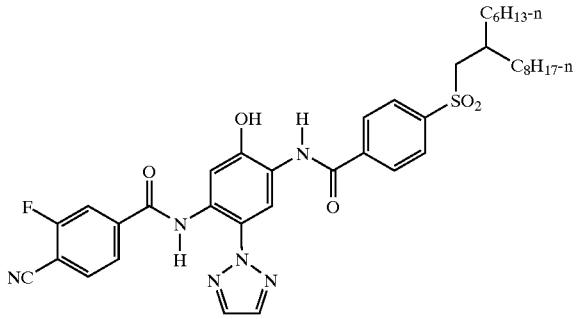
IC-24
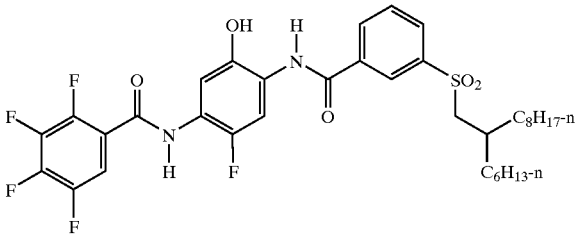
IC-25
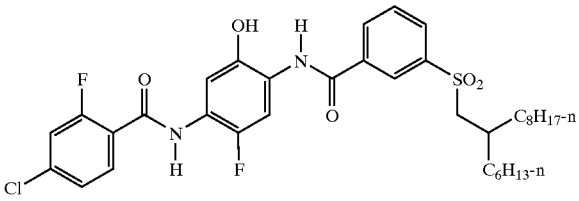
-continued
IC-26
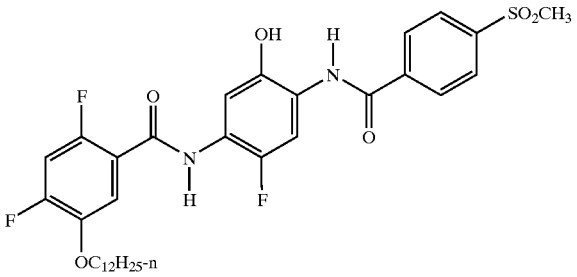
IC-27
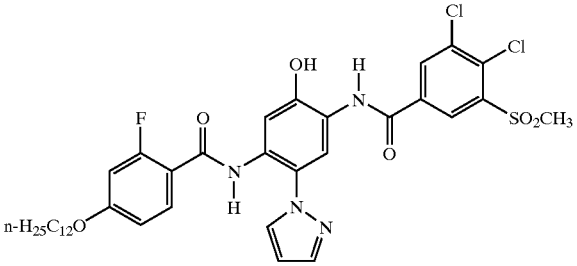
IC-28
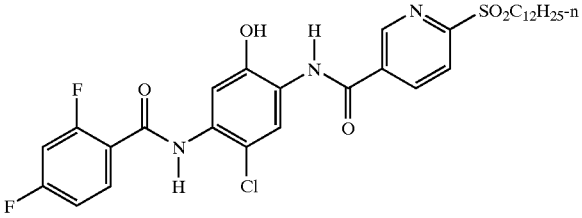
IC-29
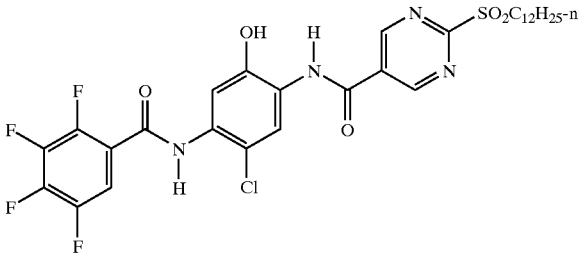
IC-30
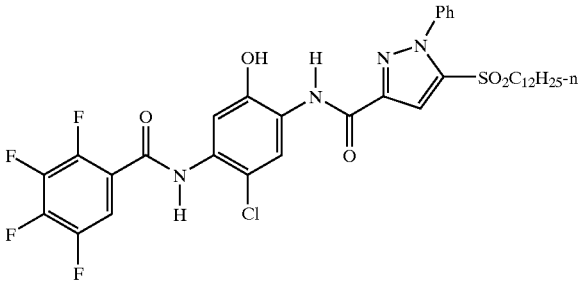

The couplers useful in the invention are those that are capable of forming dyes with color developers such as 4-amino-3-methyl-N-ethyl-N-(2-methanesulfonamidoethyl) aniline sesquisulfate hydrate, the dyes from which have "in film" $\lambda_{max}$ values in their absorption spectra in the 700–900 nm range.

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamnoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfmyl, hexadecylsulfinyl, phenylsulfinyl, 4-nonylphenylsulfmyl, and p-tolylsulfmyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, and releasing or releasable groups. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a melt and coated as a layer described herein on a support to form part of a photographic element. When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, -acyloxy, amino, anilino, carbonamido, carbainoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, and subbing layers.

If desired, the photographic element can be used in conjunction with an applied magnetic layer as described in *Research Disclosure*, Nov. 1992, Item 34390 published by Kenneth Mason Publications, Ltd, Dudley Annex, 12a North Street, Emsworth, Hampshire P010 7DQ, ENGLAND, and as described in Hatsumi Kyoukai Koukai Gihou No. 94-6023, published March 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, Sep. 1996, Item 38957, available as described above, which is referred to herein by the term "*Research Disclosure*". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, and color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers in addition to those of the invention may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407;

5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. No. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2-or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

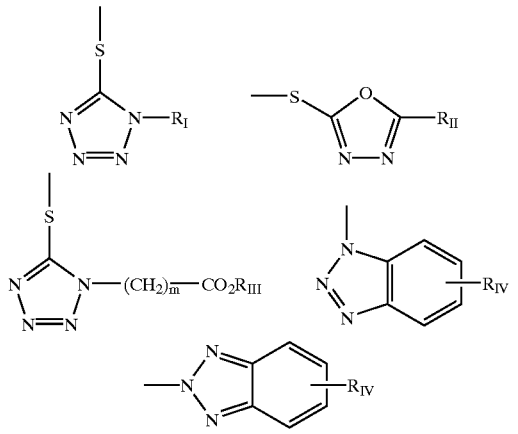

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

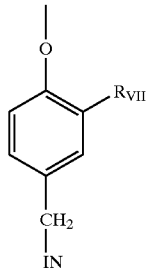

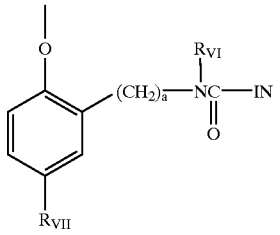

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

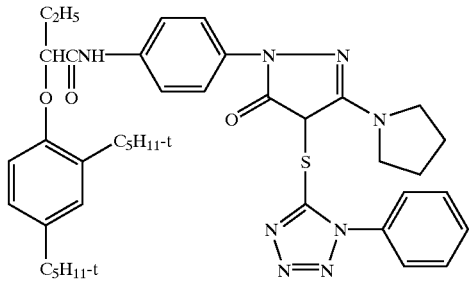

D2

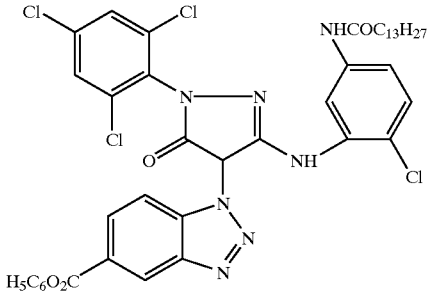

D3
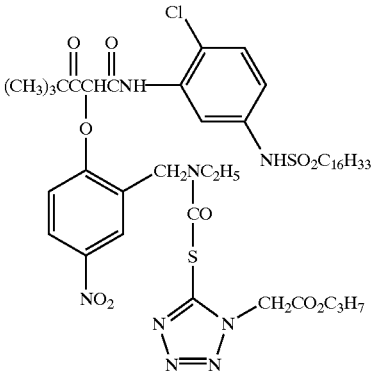
D4
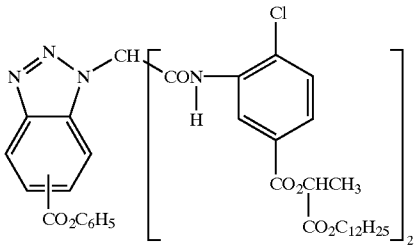
D5
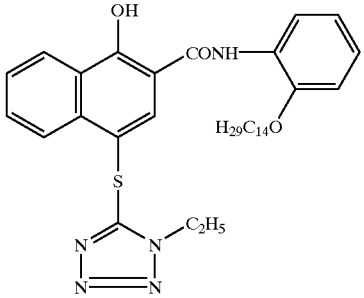
D6
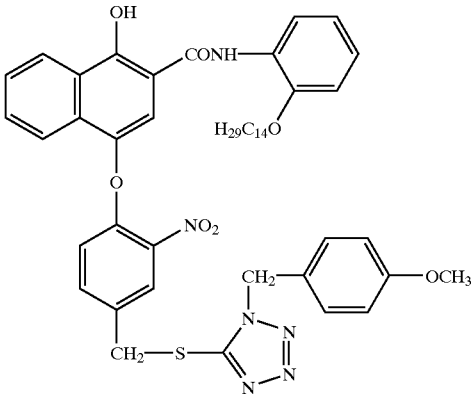
D7
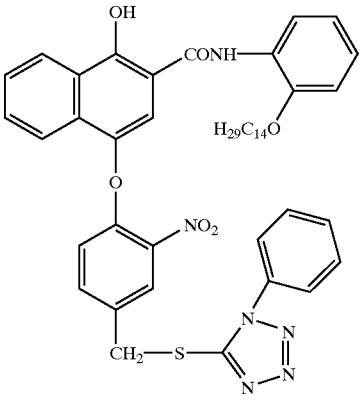
D8
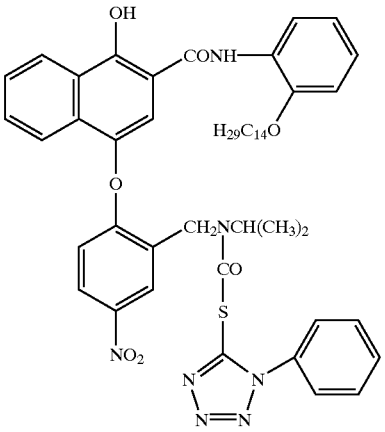
D9
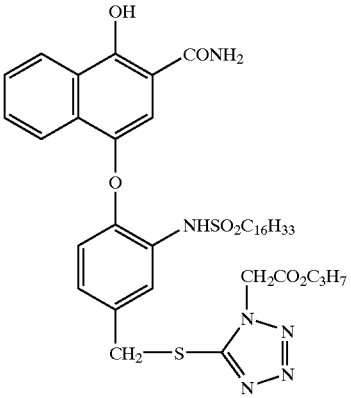

-continued

D10

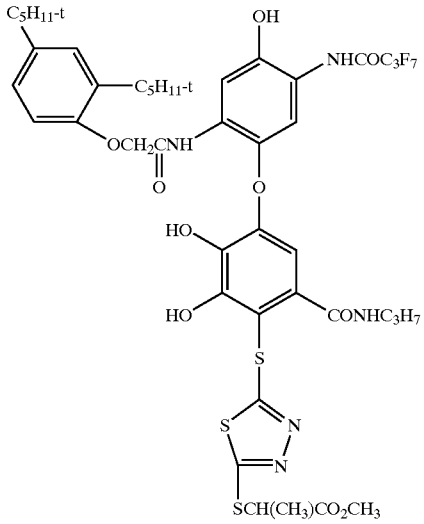

D11

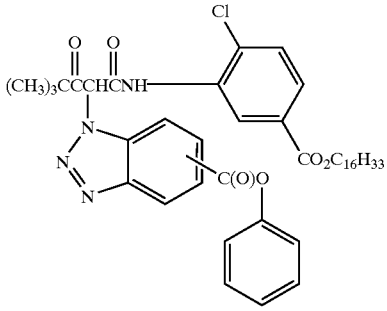

D12

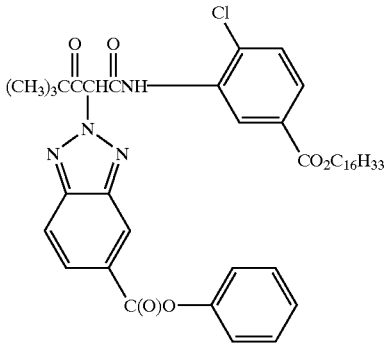

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Conventional radiation-sensitive silver halide emulsions can be employed in the practice of this invention. Such emulsions are illustrated by *Research Disclosure*, Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. No. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111 } tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111 } tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111 } tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. If desired "Redox Amplification" as described in Research Disclosure XVIIIB(5) may be used.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3'15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal elements are typically sold packaged with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylanihne hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

A direct-view photographic element is defined as one which yields a color image that is designed to be viewed directly (1) by reflected light, such as a photographic paper print, (2) by transmitted light, such as a display transparency, or (3) by projection, such as a color slide or a motion picture print. These direct-view elements may be exposed and processed in a variety of ways. For example, paper prints, display transparencies, and motion picture prints are typically produced by optically printing an image from a color negative onto the direct-viewing element and processing though an appropriate negative-working photographic process to give a positive color image. Color slides may be produced in a similar manner but are more typically produced by exposing the film directly in a camera and processing through a reversal color process or a direct positive process to give a positive color image. The image may also be produced by alternative processes such as digital printing.

Each of these types of photographic elements has its own particular requirements for dye hue, but in general they all require cyan dyes that whose absorption bands are less deeply absorbing (that is, shifted away from the red end of the spectrum) than color negative films. This is because dyes in direct viewing elements are selected to have the best appearance when viewed by human eyes, whereas the dyes in color negative materials designed for optical printing are designed to best match the spectral sensitivities of the print materials.

The compound of the invention is a coupler compound as described in the foregoing description of the photographic element. The process of the invention includes a method of forming an image in the described silver halide element after the same has been exposed to light comprising contacting the exposed element with a color developing compound such as a para-phenylene diamine.

SYNTHESIS EXAMPLE

The following is an example of how couplers useful in the invention may be synthesized:

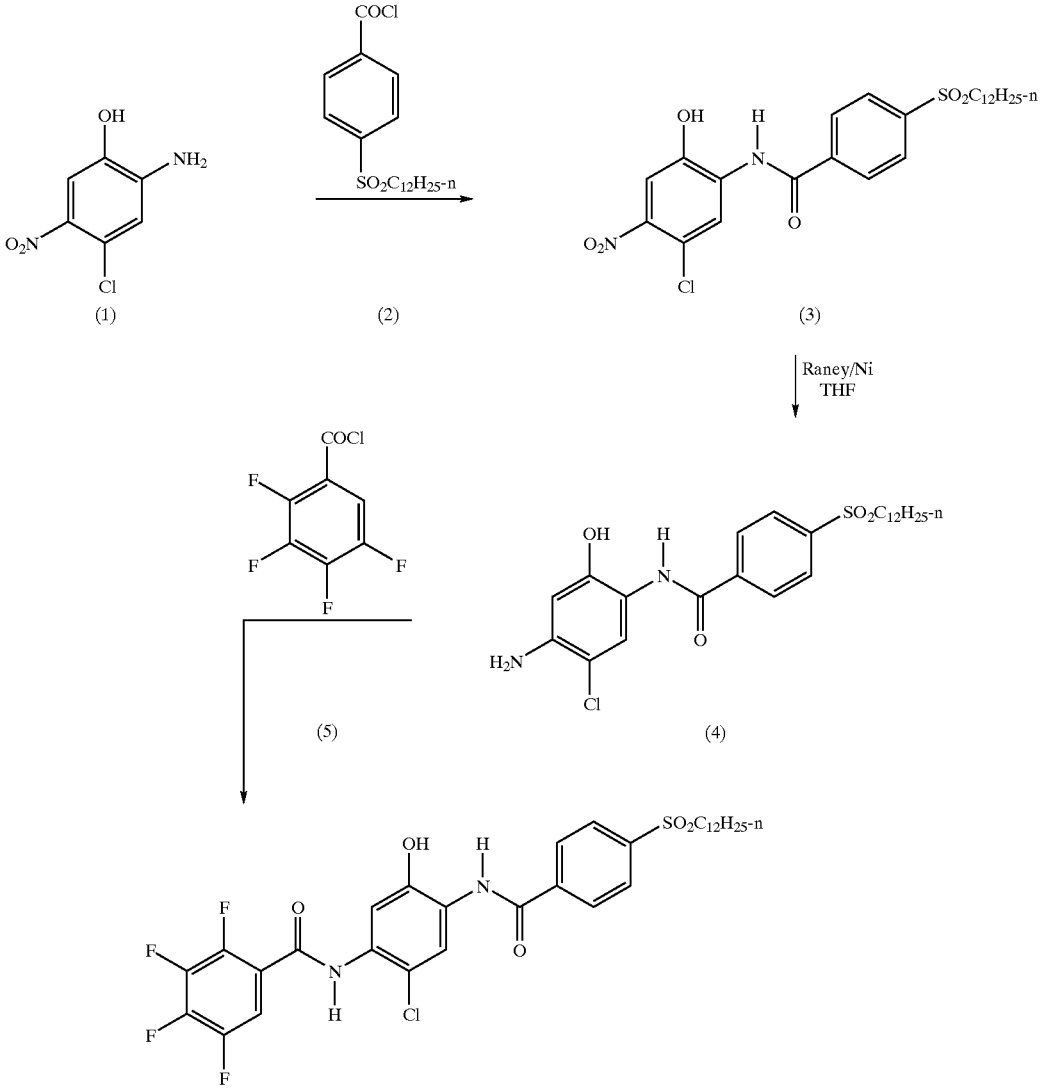

IC-8

4-Dodecylsulfonylbenzoyl Chloride (2)

4-Dodecylsulfonylbenzoic acid (25.45 g, 71.8 mMole) was added to thionyl chloride (100 mL) together with 2 drops of ditnethylformamide. The resulting mixture was heated to 60° C. for 3 hours. The solution was then cooled, concentrated under reduced pressure and co-evaporated with ethyl acetate (2×5 mL). The residual solid, assuming a quantitative yield, was taken on to the next step.

Compound (3)

2-Amino-4-chloro-5-nitrophenol (1), (12.18 g, 64.62 mMole) and compound (2) (71.8 mMole), as described above, were heated in acetonitrile (250 mL) under gentle reflux for 2 hours. The dark colored solution was cooled and concentrated under reduced pressure. When crystallization of the product began, concentrating was stopped and the reaction mixture treated with additional acetonitrile (100 mL) and cooled to 4° C. for several hours. The yellow solid was filtered off, washed with a little cold acetonitrile and air-dried. Yield 28.5 g.

Compound (4).

Compound (3) (3.6 g, 6.95 mMole), was dissolved in tetrahydrofuran (100 mL), and Raney-Nickel which had been pre-washed with water (×3) and tetrahydroflran (×3), was added. The mixture was then hydrogenated at room temperature and 352 kg/dm$^2$ (50 psi) of hydrogen. The reaction is complete in approximately 1.5 hours. After this period, the catalyst is carefully filtered off and the solution concentrated under reduced pressure. The solid residue was washed out of the flask with ether, washed with a little ether and air-dried. Yield 2.8 g.

Inventive Coupler IC-8.

Compound (4), (2.0 g, 4.04 mMole) was dissolved in tetrahydrofuran (30mL), and dry pyridine (0.36mL, 4.44 mMole) added. The solution was cooled in an ice bath while 2,3,4,5-tetrafluorobenzoyl chloride (5), (0.6mL, 4.44 mMole) in ethyl acetate (5 mL) was added drop by drop. At the end of the addition, the cooling bath was removed and the reaction mixture allowed to come to room temperature. After 15 minutes the reaction was diluted with ethyl acetate, washed with 2N—HCl (2×50 mL), dried ($MgSO_4$), and concentrated under reduced pressure. Before all of the solvent had been removed the product began to crystallize. The residue was treated with ether and allowed to stand for several hours at room temperature. The white solid of Inventive Coupler IC-8 was filtered off, washed with a little ether and air-dried. Yield 2.2 g.

Dye Property Examples

Using procedures known to those skilled in synthetic chemistry, such as described in J. Bailey, JCS Perkin 1, 1977, 2047, the dyes of the couplers in Table 1 below were prepared by coupling with 4-amino-3-methyl-N-ethyl-N-(2-methane-sulfonamidoethyl) aniline sesquisulfate hydrate, then purified by either crystallization or chromatographic techniques A 3% w/v solution of di-n-butyl sebacate was made with ethyl acetate or tetrahydrofuran and from this solution a 3% solution of the dye was prepared. If the dye was insoluble, dissolution was achieved by the addition of some methylene chloride. The solution was filtered and 0.1–0.2 mL was applied to a clear polyethylene-terephthalate support (approximately 4 cm×4 cm) and spun at 4,000 RPM using the Spin-Coating equipment, Model No. EC-101, available from Headway Research Inc., Garland Tex. The transmission spectra of the so-prepared dye samples were then recorded. The transmission spectra of the same dye in acetonitrile was also measured.

The $\lambda_{max}$ values (the wavelength of maximum absorption) was recorded for each spectra from both spin coatings and acetonitrile solution and are reported in Table 1 below. Differences in $\lambda_{max}$ between the spin coating and solution are also recorded.

In solution, all of the dyes (invention and comparison) have similar λmaxvalues and fall in the range, 628–650 nm. Upon spin coating, the $\lambda_{max}$ values of the dyes of the invention are shifted to longer wavelength or towards the infrared by 125–191 nm over the same dyes in solution. These couplers thus meet the criterion defined for "Infrared couplers". The spin-coating $\lambda_{max}$ values for the dyes from the comparison couplers are different from the solution $\lambda_{max}$ values by only 1–3 nm and indeed, CC-3 is shifted to shorter wavelength and thus away from the infrared, by 10 nm. The comparison couplers are therefore not "Infrared couplers".

TABLE 1

Spin Coating (SC), and acetonitrile solution (Soln.) Data (nm)

| Dye | $\lambda_{max}$ (Soln.) | $\lambda_{max}$ (SC) | Difference = $\lambda_{max}$ (SC.) − $\lambda_{max}$ (Soln) |
|---|---|---|---|
| CC-1 | 650 | 651 | 1 |
| CC-2 | 628 | 631 | 3 |
| CC-3 | 634 | 624 | −10* |
| IC-1 | 633 | 778 | 145 |
| IC-2 | 637 | 780 | 143 |
| IC-3 | 629 | 754 | 125 |
| IC-4 | 628 | 760 | 132 |
| IC-5 | 634 | 789 | 155 |
| IC-6 | 632 | 786 | 154 |
| IC-7 | 631 | 758 | 127 |

TABLE 1-continued

Spin Coating (SC), and acetonitrile solution (Soln.) Data (nm)

| Dye | $\lambda_{max}$ (Soln.) | $\lambda_{max}$ (SC) | Difference = $\lambda_{max}$ (SC.) − $\lambda_{max}$ (Soln) |
|---|---|---|---|
| IC-8 | 640 | 808 | 168 |
| IC-9 | 640 | 813 | 173 |
| IC-11 | 640 | 806 | 166 |
| IC-15 | 636 | 827 | 191 |
| IC-16 | 637 | 800 | 163 |

*The negative sign indicates a hypsochromic shift (shorter wavelength).

The comparison couplers used were as follows:

CC-1

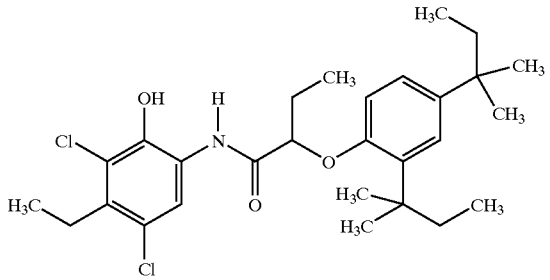

CC-2

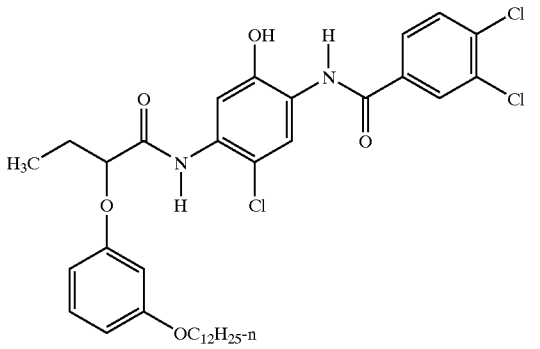

CC-3

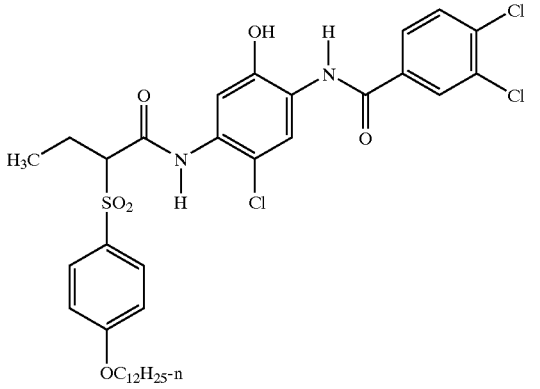

Preparation of Photographic Elements

On a gel-subbed, polyethylene-coated paper support were coated the following layers.

First Layer

A underlayer containing 3.23 grams gelatin per square meter.

Second Layer

A photosensitive layer containing (per square mete) 2.15 grams gelatin an amount of red-sensitive silver chloride emulsion containing the amount of silver(determined by the equivalency of the coupler) indicated in Table 2, 3, or 4; a dispersion containing $8.61\times10^{-4}$ mole of the coupler indicated in Table 2, 3, or 4; and 0.043 gram surfactant Alkanol XC (trademark of E. I. Dupont Co.)(in addition to the Alkanol XC used to prepare the coupler dispersion). The coupler dispersion contained the coupler, all of the gelatin in the layer except that supplied by the emulsion, an amount of the coupler solvent indicated in Table 2, 3, or 4 equal to the weight of coupler, and 0.22 gram Alkanol XC. The ultraviolet light absorber UV-1, was added in an amount equal to 1.5 molar equivalents of the inventive coupler.

Third Layer

A protective layer containing (per square meter) 1.40 grams gelatin, 0.15 gram bis(vinylsulfonyl)methane, 0.043 gram Alkanol XC, and $4.40\times10^{-6}$ gram tetraethylammonium perfluorooctanesulfonate.

The coupler solvent and components used were:

S-1

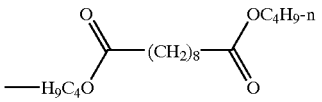

UV-1

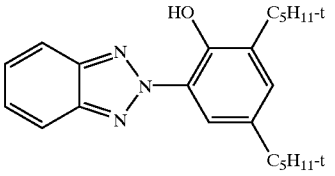

Comparison couplers CC-1 and CC-3, like the couplers of the invention are phenolic. They are included because they are currently used in commercially available color photographic papers and are typical of cyan couplers known in the photographic art. They are unlike the couplers of the invention because they do not have the substituents necessary to make them "Infrared couplers".

Preparation of Processed Photographic Examples

Processed samples were prepared by exposing the coatings through a step wedge and processing as follows:

| Process Step | Time (min.) | Temp. (° C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts per liter of solution):

| Developer | |
|---|---|
| Triethanolamine | 12.41 g |
| Blankophor REU (trademark of Mobay Corp.) | 2.30 g |
| Lithium polystyrene sulfonate | 0.09 g |
| N,N-Diethylhydroxylamine | 4.59 g |
| Lithium sulfate | 2.70 g |
| Developing agent Dev-1 | 5.00 g |
| 1-Hydroxyethyl-1,1-diphosphonic acid | 0.49 g |
| Potassium carbonate, anhydrous | 21.16 g |

-continued

| | |
|---|---|
| Potassium chloride | 1.60 g |
| Potassium bromide | 7.00 mg |
| pH adjusted to 10.4 at 26.7° C. | |
| Bleach-Fix | |
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetraacetate | 48.58 g |
| Ethylenediaminetetraacetic acid | 3.86 g |
| pH adjusted to 6.7 at 26.7° C. | |

Dev-1

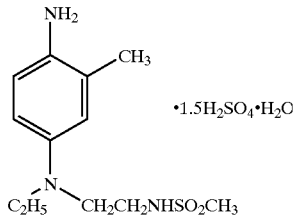

The spectra of the resulting dyes were measured and normalized to a maximum absorption of 1.00. The wavelength of maximum absorption was recorded as the $\lambda_{max}$. As can be seen from Table 2, the coupler of the invention is shifted well out of the visible region of the electromagnetic spectrum and into the infrared region. In a photographic element, couplers that give dyes on coupling with oxidized color developer, with $\lambda_{max}$ values so far shifted into the infrared are highly desirable for recording metadata.

TABLE 2

Couplers Dispersed in Solvent S-1

| Comparison or Invention | Coupler | Ag (mg/m$^2$) | $\lambda_{max}$ (Film) (nm) | $\lambda_{max}$ (Soln.) (nm) | $\Delta\lambda_{max}$ (Film-Soln) (nm) |
|---|---|---|---|---|---|
| Comparison | CC-1 | 17 | 664 | 650 | 14 |
| Comparison | CC-3 | 17 | 632 | 634 | −2* |
| Invention | IC-16 | 17 | 803 | 637 | 166 |

*The negative sign indicates a hypsochromic shift (shorter wavelength).

The data in Tables 1 and 2 show that all of the phenolic couplers of the present invention form dyes in both spin coatings and film that are shifted bathochromically and into the infrared.

The entire contents of the patents and other publications referred to in this specification are incorporated herein by reference.

What is claimed is:

1. A photographic element comprising a light-sensitive silver halide emulsion layer having associated therewith a coupler that forms a dye for which the $\lambda_{max}$ using spin-coating is shifted towards the infrared region of the spectrum by at least 30 nm, when compared to the $\lambda_{max}$ of the same dye in solution form, to a value of at least 700 nm.

2. The element of claim 1 wherein the "Infrared coupler" is represented by the formula (I):

(I)

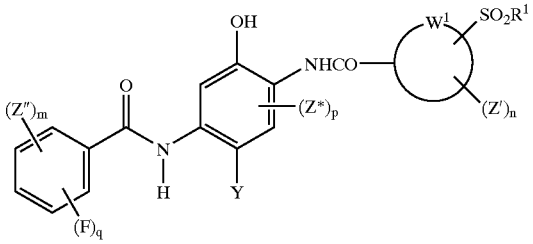

wherein:

F is a fluorine atom where q is 1 to 4;

Y is H or a coupling-off group;

$R^1$ is an alkyl, carbocyclic or heterocyclic group;

each Z', Z" and Z* is an independently selected substituent group where n and m are independently 0 to 4 and, p is 0 to 2;

$W^1$ represents the atoms necessary to complete a carbocyclic or heterocyclic ring group; and provided that the combined sum of the aliphatic carbon atoms in $R^1$, all Z', Z" and Z* is at least 8.

3. The element of claim 2 wherein not more than 1 fluorine atom occupies a position ortho to the amido carbonyl on the phenol ring.

4. The element of claim 2 wherein no fluorine atom occupies a position ortho to the amido carbonyl on the phenol ring.

5. The element of clam 2 wherein the coupler is represented by formula (II):

(II)

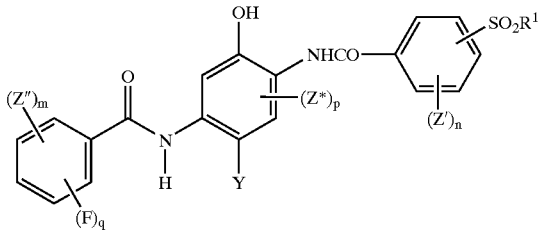

6. The element of claim 2 wherein the coupler is represented by formulae (III)–(VI):

(III)

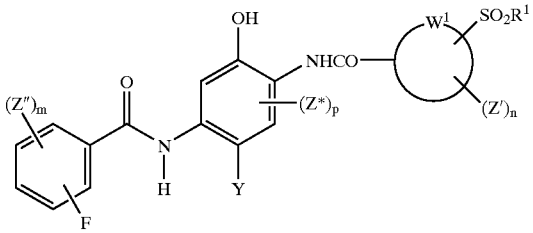

-continued (IV)

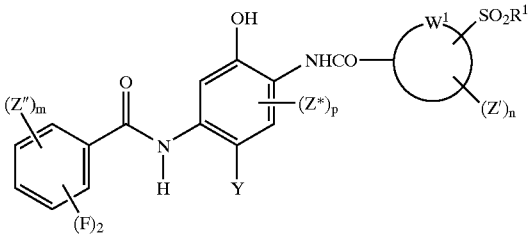

(V)

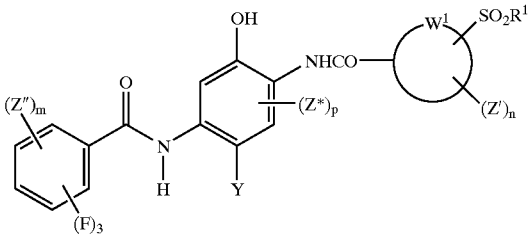

(VI)

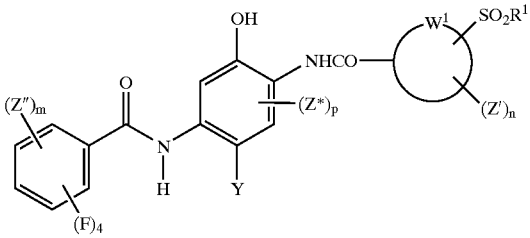

7. The element of claim 6 wherein $W^1$ represents the atoms necessary to form a phenyl ring.

8. The element of claim 2 wherein the coupler is represent by formulae (VII)–(XIV):

(VII)

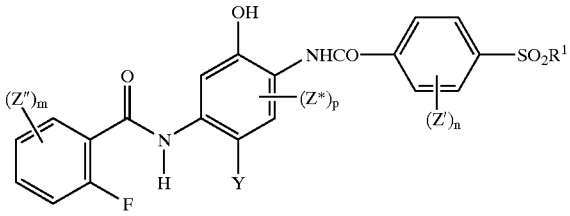

(VIII)

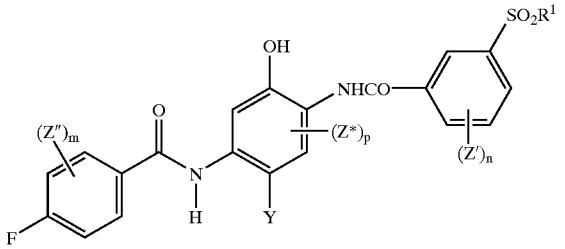

-continued (IX)

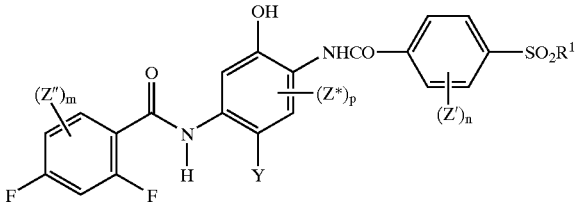

(X)

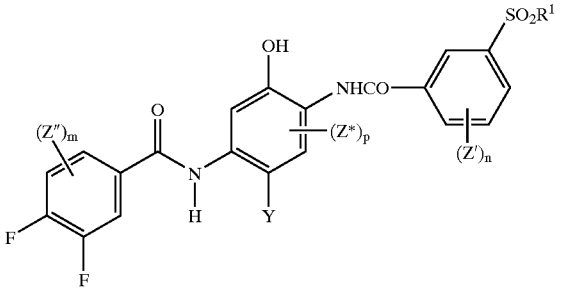

(XI)

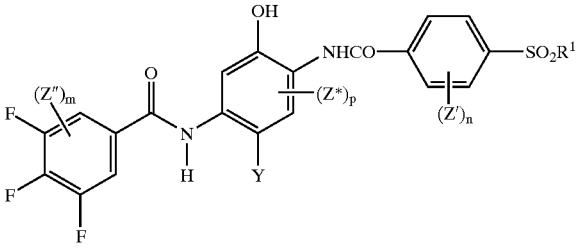

(XII)

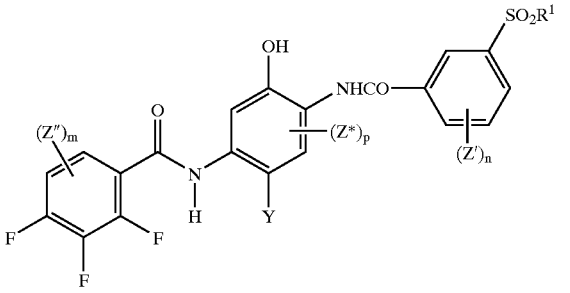

(XIII)

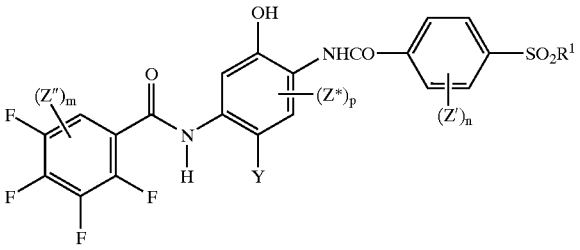

-continued (XIV)

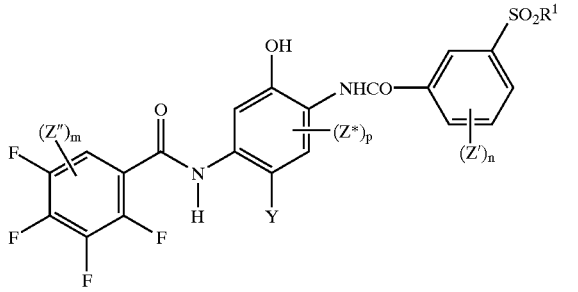

9. The element of claim 2 wherein $W^1$ represents the atoms necessary to complete a benzimidazolyl, benzoselenazolyl, benzothiazolyl, benzoxazolyl, chromonyl, furyl, imidazolyl, indazolyl, indolyl, isoquinolyl, isothiazolyl, isoxazolyl, morpholinyl, oxadiazolyl, oxazolyl, picolinyl, piperidinyl, purinyl, pyradazinyl, pyranyl, pyrazinyl, pyrazolyl, pyridyl, pyrimidinyl, pyrrolyl, pyrrolidinyl, quinaldinyl, quinazolinyl, quinolyl, quinoxalinyl, selenazoyl, tellurazolyl, tetrazolyl, tetrahydrofulryl, thiadiazolyl, thiamorpholinyl, thiatriazolyl, thiazolyl, thienyl, thiophenyl, triazinyl or triazolyl group.

10. The element of claim 6 wherein $W^1$ represents the atoms necessary to complete a benzimidazole, benzotriazole, furan, imidazole, indazole, indole, isoquinoline, purine, pyrazole, pyridine, pyrimidine, pyrrole, quinoline, thiophene, 1,2,3-triazole, 1,2,4-triazole, or 1,3,5-triazine ring group.

11. The element of claim 2 wherein $W^1$ represents the atoms necessary to complete a pyridine ring group.

12. The element of claim 7 wherein $R^1$ is a straight chain alkyl group of between 1–30 carbon atoms.

13. The element of claim 7 wherein $R^1$ is a branched alkyl group of between 1–30 carbon atoms.

14. The element of claim 5 wherein at least one Z' group is selected from the group consisting of acyl, acyloxy, alkenyl, alkyl, alkoxy, aryl, aryloxy, carbamoyl, carbonamido, carboxy, cyano, halogen, heterocyclic, hydroxy, nitro, oxycarbonyl, oxysulfonyl, sulfamoyl, sulfonamido, sulfonyl, sulfoxide, thio, and ureido groups.

15. The element of claim 14 wherein at least one Z' group is an alkyl group, an alkoxy group or a halogen.

16. The element of claim 2 wherein Y is a coupling-off group bonded to the coupler by a heteroatom.

17. The element of claim 2 wherein Y is selected from the group consisting aryloxy, alkoxy, arylthio, alkylthio, halogen and heterocyclic groups.

18. The element of claim 5 wherein at least one Z" is selected from the group consisting of alkyl, alkenyl, alkoxy, aryl, aryloxy, acyl, oxysulfonyl, acyloxy, oxycarbonyl, carboxy, sulfoxide, thio, sulfamoyl, sulfonamido, sulfonyl, carbamoyl, carbonamido, ureido, cyano, nitro, chloro and bromo groups.

19. The element of claim 5 wherein at least one Z' is selected from the group consisting of alkyl, alkenyl, alkoxy, aryl, aryloxy, acyl, oxysulfonyl, acyloxy, oxycarbonyl, carboxy, sulfoxide, thio, sulfamoyl, sulfonamido, sulfonyl, carbamoyl, carbonamido, ureido, cyano, nitro, and halogen groups; and at least one Z" is selected from the group consisting of alkyl, alkoxy, aryl, aryloxy, oxysulfonyl, sulfonyl, sulfoxide, thio, sulfamoyl, sulfonamido, carbonamido, ureido, cyano, and halogen groups.

20. A photographic element in accordance with claim 1 wherein the photographic coupler is selected from the group consisting of the following.

IC-1

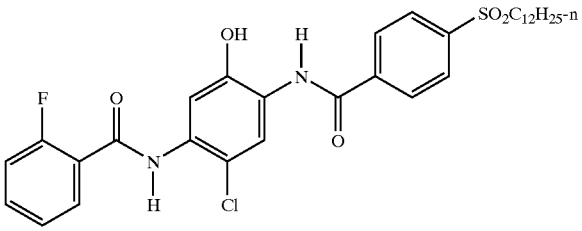

IC-2

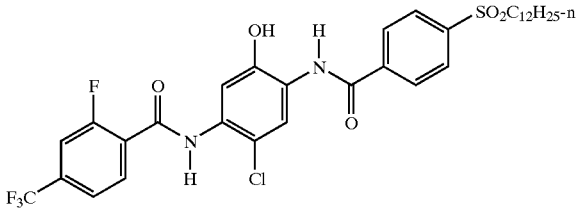

IC-3

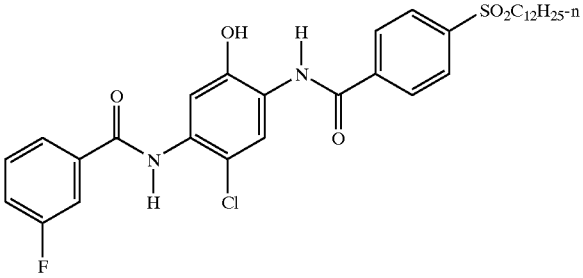

IC-4

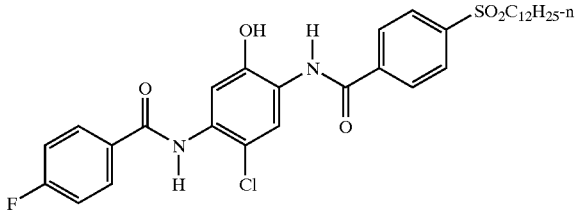

IC-5

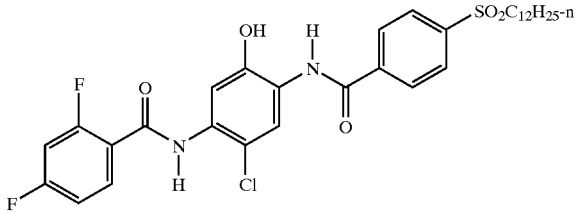

-continued

IC-6

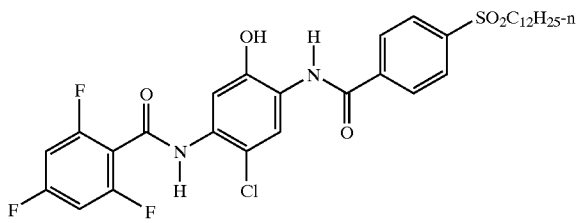

IC-7

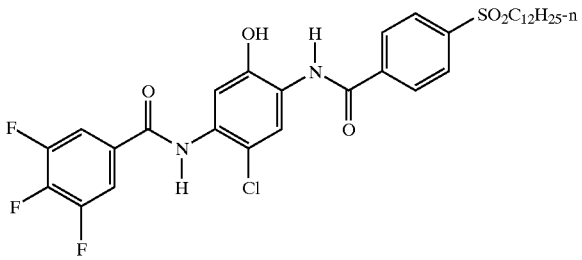

IC-8

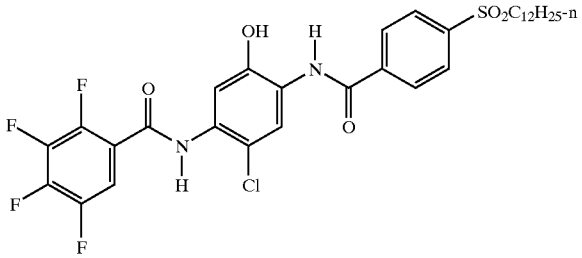

IC-9

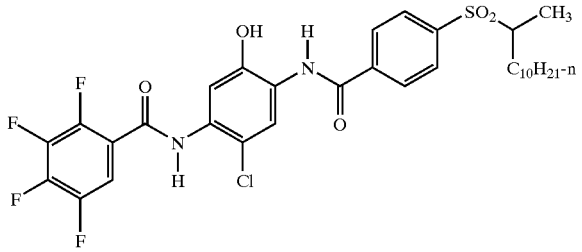

IC-10

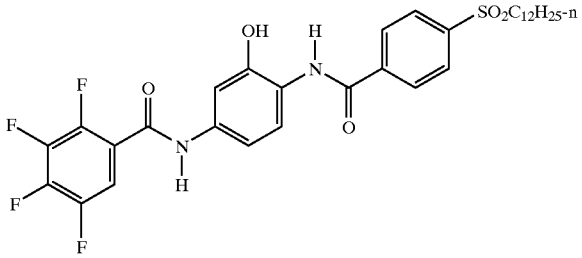

-continued
IC-11
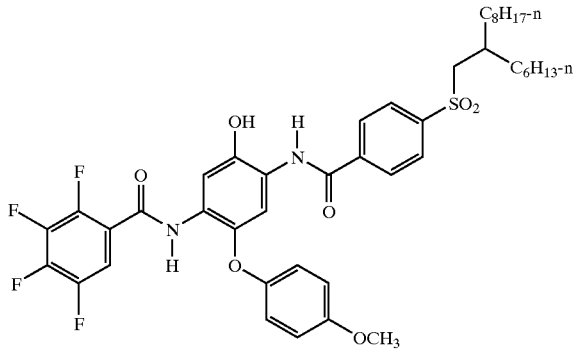
IC-12
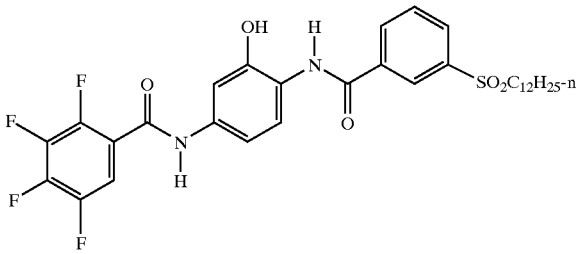
IC-13
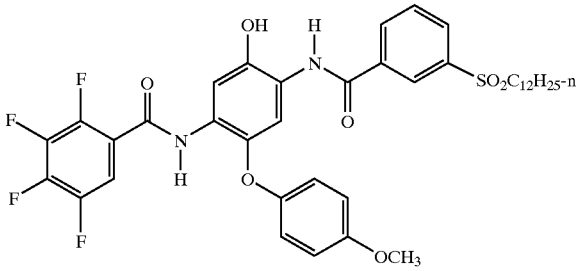
IC-14
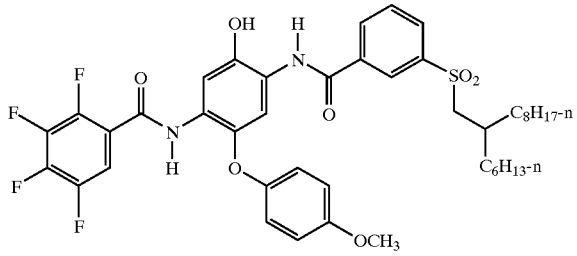
IC-15
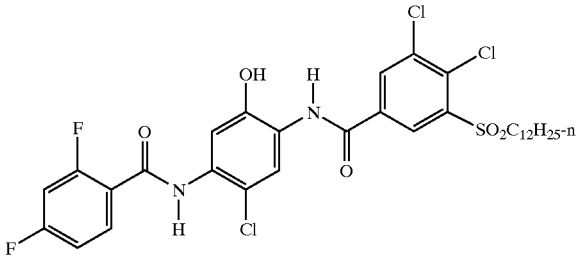
-continued
IC-16
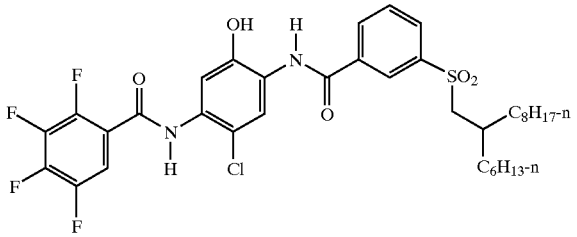
IC-17
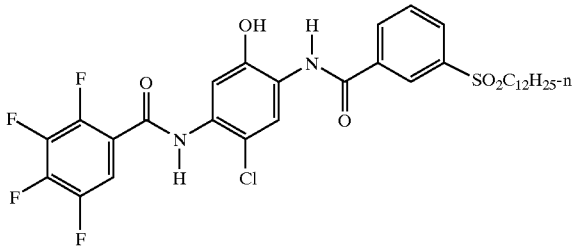
IC-18
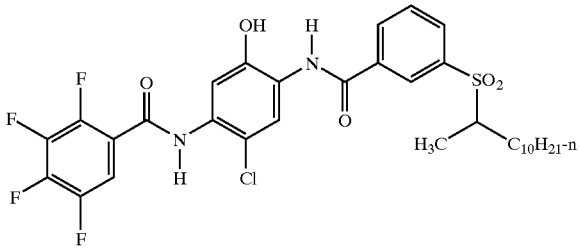
IC-19
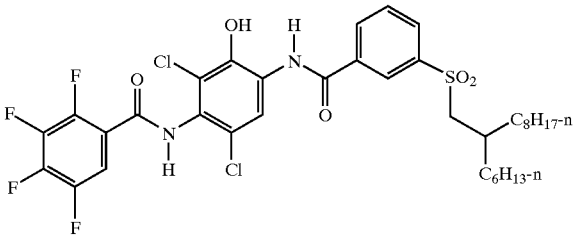
IC-20
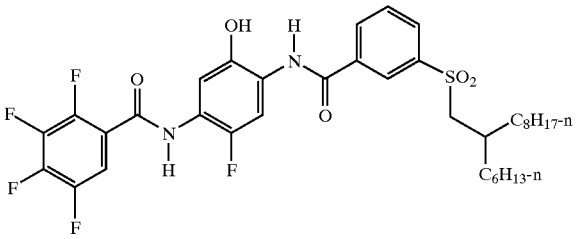

-continued
IC-21
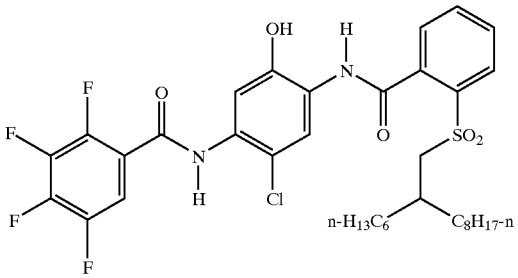
IC-22
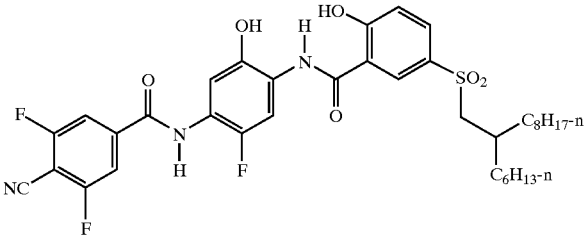
IC-23
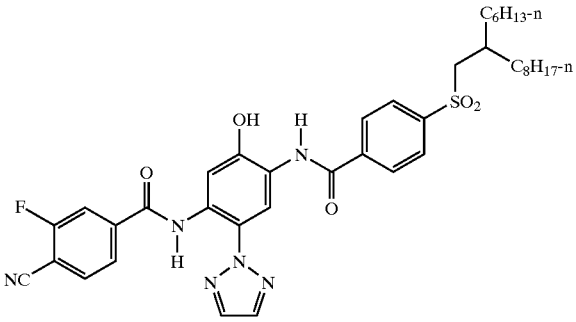
IC-24
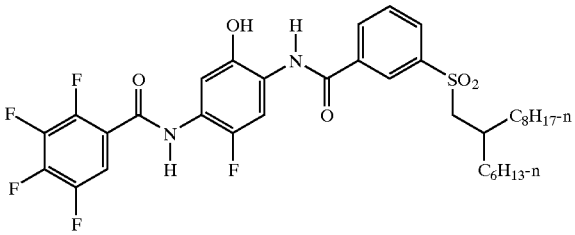
IC-25
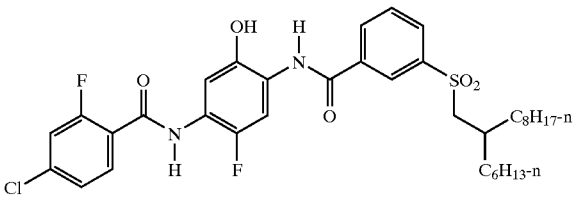
-continued
IC-26
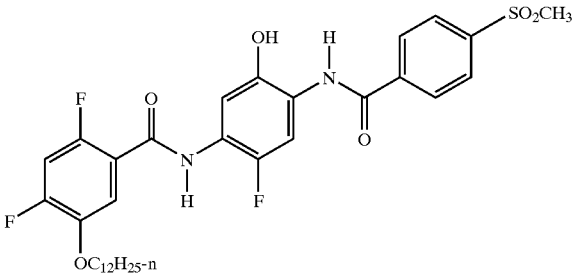
IC-27
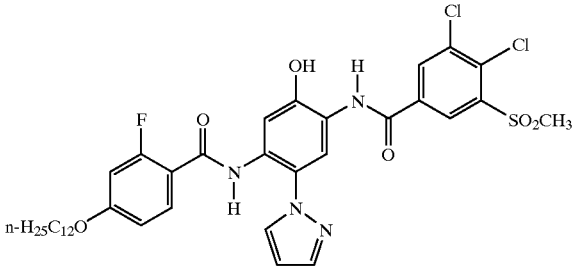
IC-28
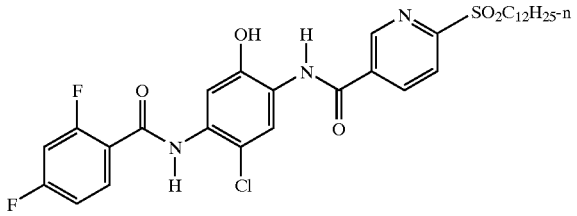
IC-29
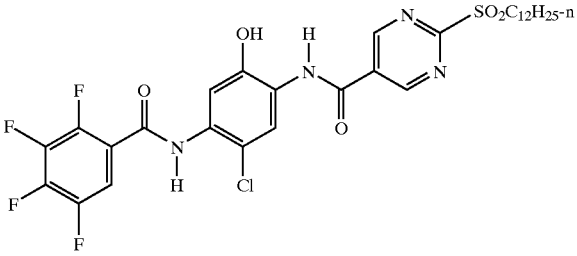
IC-30
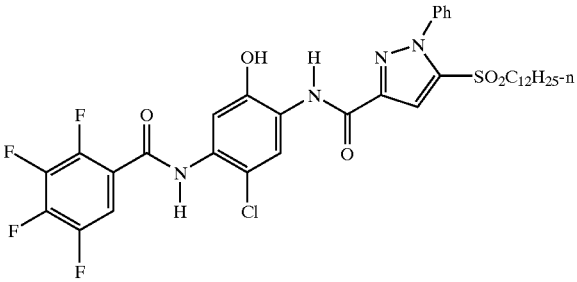

21. The photographic element of claim 1 comprising a support bearing at least one red sensitive photographic silver halide emulsion layer comprising at least one cyan image dye-forming coupler, at least one green sensitive photographic silver halide emulsion layer comprising at least one magenta image dye-forming coupler;

at least one blue sensitive photographic silver halide emulsion layer comprising at least one yellow image dye-forming coupler; and at least one photographic silver halide emulsion layer comprising at least one infrared image dye-forming coupler.

22. The element of claim 1 provided on a reflective support.

23. The element of claim 1 additionally comprising a transparent support.

24. The element of claim 1 wherein the element is a motion picture element.

25. The element of claim 1 packaged with instructions to process using a color negative print developing process.

26. The element of claim 1 packaged with instruction to process using a color paper developing process.

27. The element of claim 1 packaged with instruction to process using a motion picture developing process.

28. The element of claim 1 packaged with instructions to process using a color reversal developing process.

29. The element of claim 1 packaged with instructions to process using a color negative process.

30. A photographic element comprising a light-sensitive silver halide emulsion layer having associated therewith an "Infrared coupler" that forms a dye for which the $\lambda_{max}$ using spin-coating is shifted towards the infrared region of the spectrum by at least 30 nm, when compared to that of the same dye in solution form, and has the formula (I):

(I)

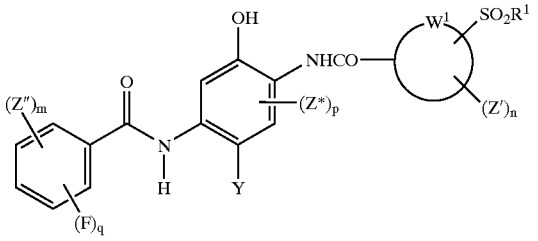

wherein:

F is a fluorine atom where q is 1 to 4;

Y is H or a coupling-off group;

$R^1$ is an alkyl, carbocyclic or heterocyclic group; each Z', Z" and Z* is an independently selected substituent group where n and m are independently 0 to 4 and p is 0 to 2;

$W^1$ represents the atoms necessary to complete a carbocyclic or heterocyclic ring group;

provided that the combined sum of the aliphatic carbon atoms in $R^1$, all Z', Z" and Z* is at least 8; and further provided that the wavelength of maximum spectral absorption of the dye $\lambda_{max}$ formed by the coupler and the developer 4-amino-3-methyl-N-ethyl-N-(2-methanesulfonamidoethyl) aniline sesquisulfate hydrate, is greater than 700 nm.

31. The photographic element of claim 1 in which the "Infrared coupler" is a coupler that is shifted towards the infrared region of the spectrum by at least 40 nm when compared to that of the same dye in solution form.

32. The photographic element of claim 1 in which the "Infrared coupler" is a coupler that is shifted towards the infrared region of the spectrum by at least 50 nm when compared to that of the same dye in solution form.

33. The element of claim 30 in which the $\lambda_{max}$ using spin-coating, is greater than 750 nm.

34. The element of claim 33 in which the $\lambda_{max}$ using spin-coating, is greater than 800 nm.

35. A process for forming an image in an element as described in claim 1 after the element has been imagewise exposed to light comprising contacting the element with a color-developing compound.

36. The process of claim 35 in which the developer is p-phenylene diamine compound.

* * * * *